US007870764B2

(12) United States Patent
Burmesch

(10) Patent No.: US 7,870,764 B2
(45) Date of Patent: Jan. 18, 2011

(54) CABLE LOCK WITH RESETTABLE COMBINATION

(75) Inventor: Gary Burmesch, Port Washington, WI (US)

(73) Assignee: Master Lock Company LLC, Oak Creek, WI (US)

( * ) Notice: Subject to any disclaimer, the term of this patent is extended or adjusted under 35 U.S.C. 154(b) by 453 days.

(21) Appl. No.: 12/024,442

(22) Filed: Feb. 1, 2008

(65) Prior Publication Data

US 2008/0184748 A1 Aug. 7, 2008

Related U.S. Application Data

(60) Provisional application No. 60/899,194, filed on Feb. 2, 2007.

(51) Int. Cl.
*E05B 37/02* (2006.01)

(52) U.S. Cl. ..... 70/26; 70/30; 70/38 C; 70/51; 70/233; 70/386

(58) Field of Classification Search ..... 70/21–26, 70/29, 30, 49, 51, 14, 18, 20, 38 C, 233, 386, 70/DIG. 7, DIG. 9
See application file for complete search history.

(56) References Cited

U.S. PATENT DOCUMENTS

| | | | | |
|---|---|---|---|---|
| 380,961 A | | 4/1888 | Waine | |
| 465,450 A | * | 12/1891 | Brooke | 70/26 |
| 507,948 A | | 10/1893 | Waine | |
| 535,128 A | * | 3/1895 | Barney | 70/59 |
| 539,650 A | | 5/1895 | Searle | |
| 1,161,562 A | | 11/1915 | Wessen | |
| 1,240,146 A | * | 9/1917 | Jackson | 70/30 |
| 1,336,309 A | * | 4/1920 | Malaczynski | 70/26 |
| 1,358,184 A | | 11/1920 | Voight | |
| 1,380,719 A | | 6/1921 | Johnson | |
| 1,384,561 A | | 7/1921 | Hampton | |
| 1,394,259 A | | 10/1921 | Johnson | |
| 1,475,256 A | | 11/1923 | Belair | |
| 1,531,451 A | | 3/1925 | Neal | |
| 1,539,301 A | | 5/1925 | Cooper | |
| 1,566,965 A | | 12/1925 | Johnson | |

(Continued)

FOREIGN PATENT DOCUMENTS

CA 1171294 7/1984

(Continued)

OTHER PUBLICATIONS

International Search Report and Written Opinion of the International Searching Authority from International Application No. PCT/US08/01427, mailed Jun. 19, 2008.

(Continued)

*Primary Examiner*—Lloyd A Gall
(74) *Attorney, Agent, or Firm*—Calfee, Halter & Griswold LLP

(57) ABSTRACT

A lock body includes a lock mechanism adapted to fix and maintain an inserted securement member, such as a cable or shackle, in position within the lock body. The lock mechanism may be coupled to a combination lock adapted to release the securement member upon entry of a proper combination.

17 Claims, 9 Drawing Sheets

U.S. PATENT DOCUMENTS

| | | | | | |
|---|---|---|---|---|---|
| 1,660,040 | A | | 2/1928 | Lehtonen | |
| 1,851,207 | A | | 3/1932 | Neal | |
| 1,855,686 | A | | 4/1932 | Neal | |
| 1,900,242 | A | | 3/1933 | Latou | |
| 2,190,661 | A | | 2/1940 | Hauer | |
| 2,390,885 | A | | 12/1945 | Kelley | |
| 2,570,662 | A | | 10/1951 | Gray | |
| 2,759,349 | A | | 8/1956 | McKee | |
| 3,017,678 | A | | 1/1962 | Christensen | |
| 3,435,642 | A | | 4/1969 | Del Pesco | |
| 3,670,535 | A | * | 6/1972 | Stettner et al. | 70/58 |
| 3,841,118 | A | | 10/1974 | Stone | |
| 3,907,255 | A | | 9/1975 | McElroy | |
| 4,236,394 | A | | 12/1980 | Harrington et al. | |
| 4,287,731 | A | | 9/1981 | Kruger | |
| 4,446,709 | A | | 5/1984 | Steinbach | |
| 4,509,346 | A | | 4/1985 | Szczepanek | |
| 4,574,600 | A | | 3/1986 | Moffett | |
| 4,850,207 | A | | 7/1989 | Ylven | |
| 5,109,684 | A | | 5/1992 | Grandy, Sr. | |
| 5,473,917 | A | | 12/1995 | Say | |
| 5,517,835 | A | | 5/1996 | Smith | |
| 5,548,981 | A | | 8/1996 | Kirk | |
| 5,611,225 | A | | 3/1997 | Resch et al. | |
| 5,638,707 | A | | 6/1997 | Gould | |
| 5,660,064 | A | | 8/1997 | Ecker et al. | |
| 5,743,117 | A | | 4/1998 | Woo et al. | |
| 5,791,170 | A | | 8/1998 | Officer | |
| 5,868,012 | A | | 2/1999 | Chun-Te et al. | |
| 5,924,313 | A | | 7/1999 | Kuo | |
| 5,992,187 | A | * | 11/1999 | Derman | 70/58 |
| 6,003,348 | A | | 12/1999 | McCrea | |
| 6,212,919 | B1 | | 4/2001 | Gerow | |
| 6,363,758 | B1 | | 4/2002 | Ling | |
| 6,470,718 | B1 | | 10/2002 | Yang | |
| 6,526,785 | B1 | | 3/2003 | Asenstorfer et al. | |
| 6,609,399 | B1 | | 8/2003 | Daniels, Jr. | |
| 6,629,440 | B1 | | 10/2003 | Meekma et al. | |
| 6,681,603 | B1 | | 1/2004 | Yu | |
| 6,755,054 | B2 | | 6/2004 | Burmesch et al. | |
| 6,931,894 | B2 | | 8/2005 | Yu | |
| 6,997,023 | B1 | | 2/2006 | Huang | |
| 7,104,093 | B2 | * | 9/2006 | Ling et al. | 70/30 |
| 7,152,439 | B1 | * | 12/2006 | Chang | 70/30 |
| 7,526,932 | B2 | * | 5/2009 | Funtmann | 70/58 |
| 2002/0083744 | A1 | * | 7/2002 | Lai | 70/30 |
| 2003/0029207 | A1 | | 2/2003 | Young | |
| 2003/0046852 | A1 | | 3/2003 | Burmesch et al. | |
| 2003/0089141 | A1 | * | 5/2003 | Edwards et al. | 70/18 |
| 2003/0089147 | A1 | | 5/2003 | Yang | |
| 2004/0011098 | A1 | | 1/2004 | Yang | |
| 2005/0044903 | A1 | * | 3/2005 | Ling et al. | 70/30 |
| 2005/0092037 | A1 | * | 5/2005 | Meekma et al. | 70/30 |
| 2005/0155395 | A1 | * | 7/2005 | Yu | 70/30 |

FOREIGN PATENT DOCUMENTS

| | | | |
|---|---|---|---|
| CA | 2190575 | | 11/1995 |
| EP | 0681078 | A2 | 11/1995 |
| EP | 0893562 | A1 | 1/1999 |
| WO | 02/20926 | A1 | 3/2002 |

OTHER PUBLICATIONS

Partial International Search Report from PCT/US2004/031557.I.

* cited by examiner

CABLE LOCK WITH RESETTABLE COMBINATION

CROSS REFERENCE TO RELATED APPLICATIONS

This application claims the benefit of U.S. Provisional Patent Application Ser. No. 60/899,194, filed on Feb. 2, 2007 and entitled Cable Lock with Resettable Combination, the entire disclosure of which is incorporated by reference to the extent that it does not conflict with the present application.

BACKGROUND

Cable locks that utilize flexible cables of adjustable length have been used to secure items of varying size and shape. For example, U.S. Pat. No. 6,755,054, which is assigned to the assignee of the present invention and incorporated herein by reference for all purposes, describes a cable gun lock that features an adjustable locking cable that is locked into position with a keyed lock cylinder. Combination locks that include a mechanism by which the combination may be changed are described in, for example, U.S. Pat. No. 5,109,684, which is assigned to the assignee of the present invention and incorporated herein by reference for all purposes.

SUMMARY

A lock includes a lock body having a guide channel and an access orifice that provides access to the guide channel from outside the lock body. A locking mechanism is disposed within the guide channel and includes one or more locking members disposed about an interior passageway. The interior passageway is configured to allow passage of an elongate securement member through the passageway from the access orifice. The locking members are configured to selectively engage the securement member to maintain the securement member in a fixed position relative to the lock body or release the securement member such that the securement member can be moved relative to the lock body. A combination lock is mechanically coupled to the locking mechanism that is operable to place the locking mechanism in a locked condition in which the locking members secure the securement member in a fixed position and, upon entry of a proper combination, to place the locking mechanism in a released condition in which the locking members are capable of releasing the securement member. A lock system includes a lock and a length of flexible cable and/or a shackle for use as the securement member.

A method that secures a securement member within a lock body includes the steps of aligning one or more wheels of a combination lock to release a lock mechanism that is selectively secured in a locking position by the one or more wheels. The locking mechanism is moved within the guide channel to a release position. A first end of the securement member is installed into an access orifice in the lock body and into the guide channel in the lock body. The first end of the securement member is passed through an interior passageway in the locking mechanism. The locking mechanism is moved within the guide channel to the locking position such that one or more locking members coupled to the locking mechanism engage the securement member to fix and maintain its position within the lock body.

BRIEF DESCRIPTION OF THE DRAWINGS

In the accompanying drawings, which are incorporated in and constitute a part of this specification, embodiments of the invention are illustrated, which, together with the description of the invention serve to illustrate the principles of this invention. The drawings and detailed description are not intended to and do not limit the scope of the invention or any subsequent claims in any way. Instead, the drawings and description only describe embodiments of the invention and other embodiments of the invention not described are encompassed by this disclosure of the invention.

DETAILED DESCRIPTION OF THE INVENTION

The Detailed Description of the Invention merely describes preferred embodiments of the invention and is not intended to limit the scope of the claims in any way. Indeed, the invention as described by the claims and specification is broader than and unlimited by the preferred embodiments, and the terms in the claims have their full ordinary meaning.

Figure 1:
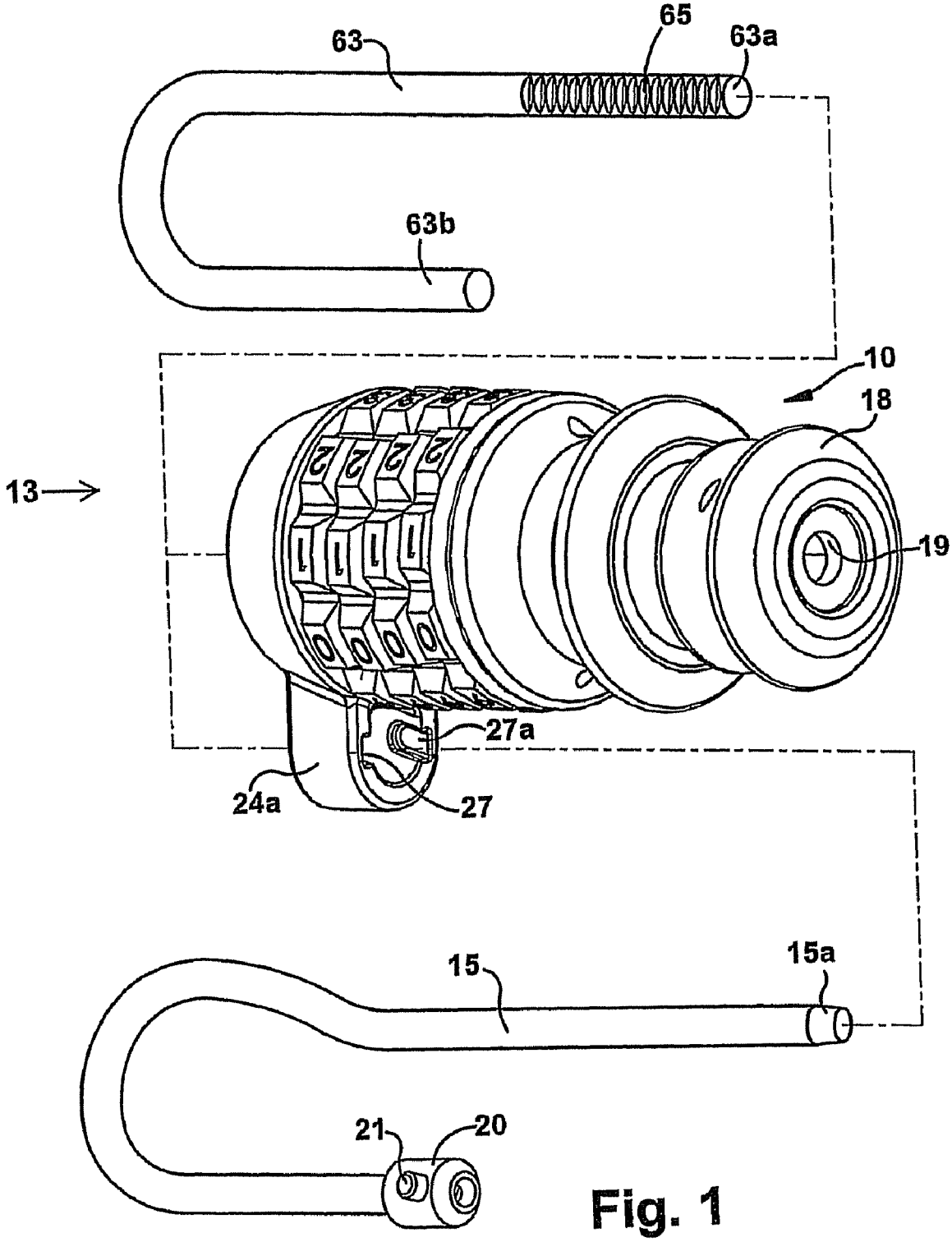
FIG. 1 is a perspective view of a resettable combination cable lock, cable, and shackle constructed in accordance with an embodiment of the present invention.
Figure 14:
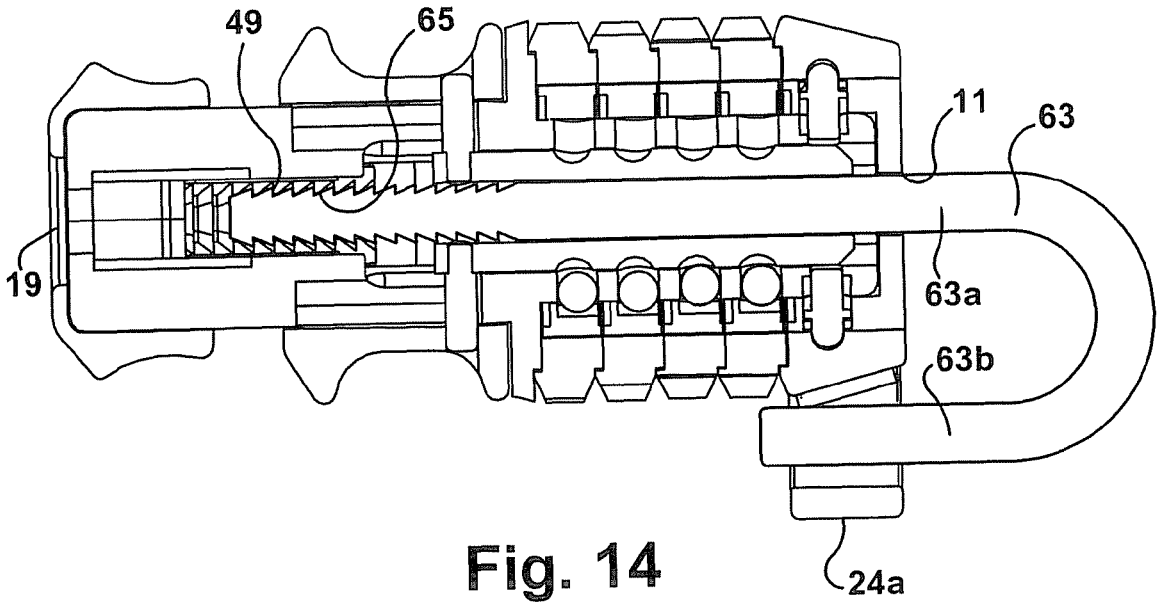
FIG. 14 is a cross section view of the resettable combination cable lock shown in FIG. 1*b*.

FIG. 1 is a perspective view of a resettable combination cable lock 10 that includes a lock body 13, a cable 15, and a shackle 63. In an exemplary embodiment, the lock body 13 is adapted to accept and retain any properly sized tubular securement member within the lock body. As such either the cable 15 or shackle 63 can be secured within the lock body 13. The lock body 13 includes a lock body housing 14 on which a housing stop 17, slide 16, bumper 18, combination wheels 12, and combination wheel retainer 24 are mounted. As will be described in more detail below, the slide 16 is moveable between the housing stop 17 and bumper 18 to retain and release the securement member within the lock body. The securement member is inserted into an access orifice 11 (shown in FIG. 1*b*) in the lock body housing and may pass through and exit the lock body housing through an exit orifice 19. The combination wheel retainer 24 includes a cable retaining ear 24*a* configured to accept and retain a cable anchor 20 on one end of the cable 15. A tapered end 15*a* of the cable 15 is passed through a hole 27 in the lock cable retaining ear 24*a* prior to being inserted into the access orifice 11. A pair of tabs 21 on the cable anchor 20 are configured to engage slots 27*a* in the hole 27. When the shackle 63 is installed in the lock body 13, a short leg 63*b* of the shackle terminates in or in close proximity to the cable retaining ear 24*a* (FIG. 14).

Figure 1A:
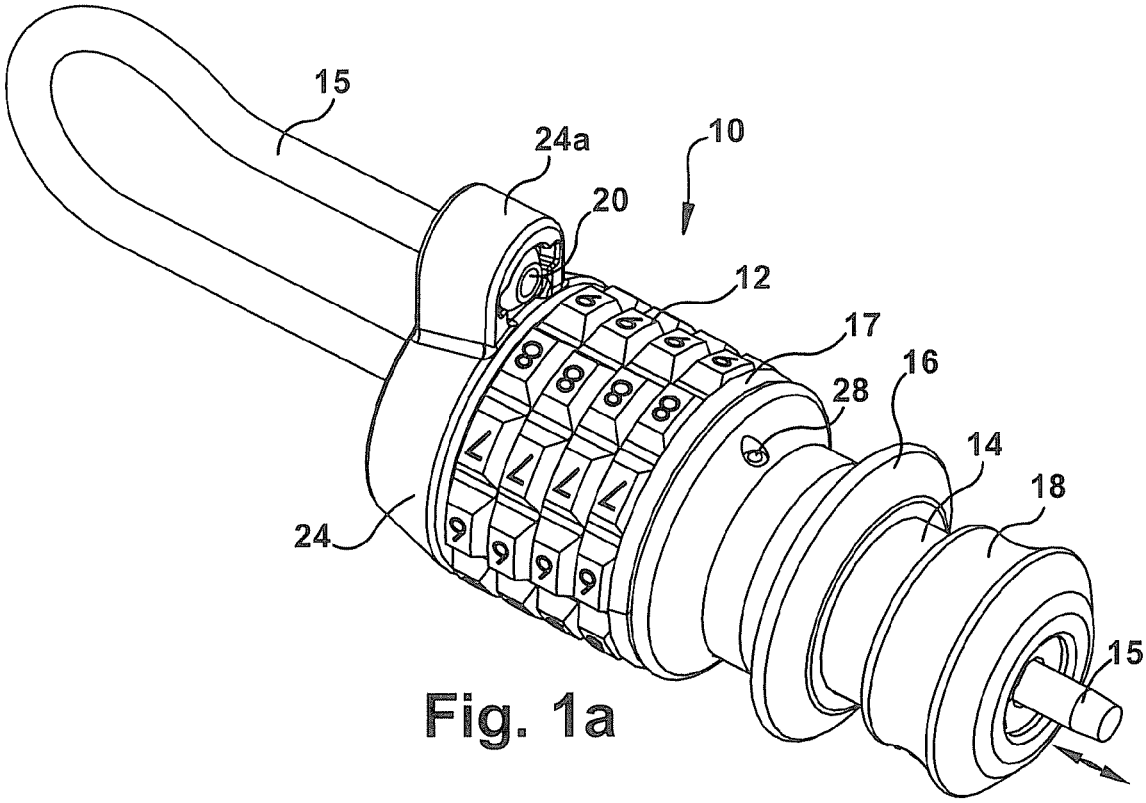
FIG. 1*a* is a perspective view of the resettable combination cable lock of FIG. 1 with the cable installed.
Figure 1B:
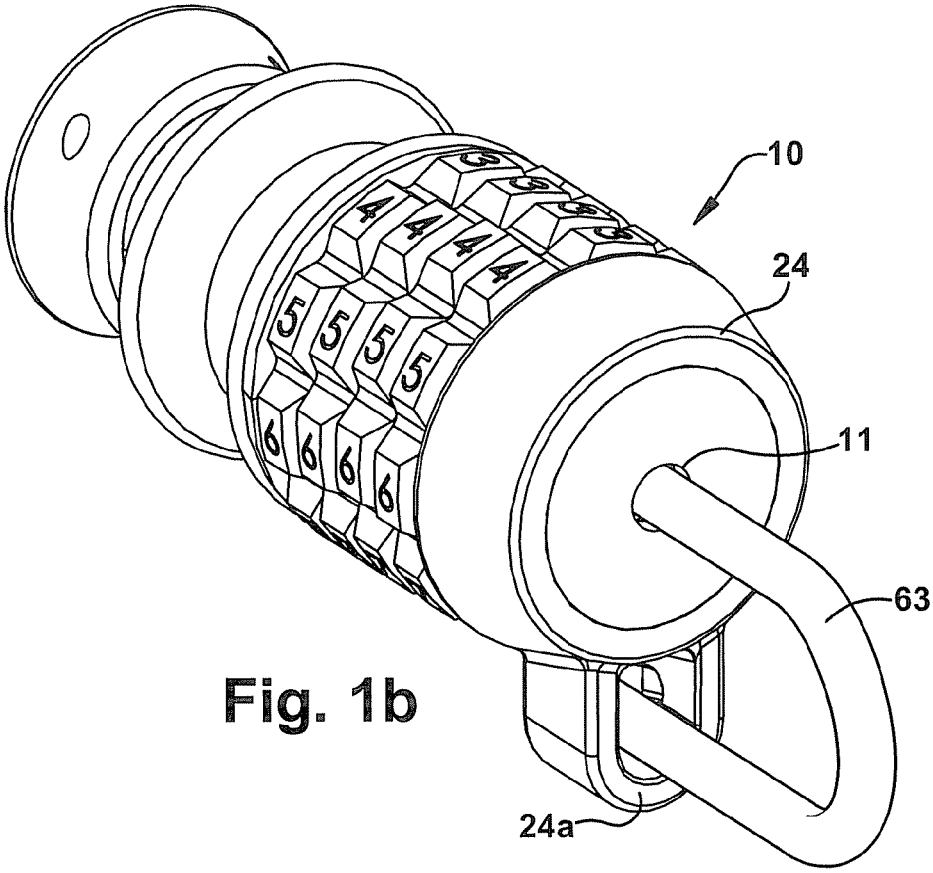
FIG. 1*b* is a front view of the resettable combination cable lock of FIG. 1 with the shackle installed.

FIG. 1*a* is a perspective view of the resettable combination cable lock 10 with the cable 15 releasably retained within the lock body housing 14. It will be apparent that cables of different lengths and made of a variety of materials may be installed in the lock body housing 14. The bumper 18 is fixed at the end of the lock body housing 14 and defines a maximum amount of travel of the slide 16 relative to the lock body housing. The slide 16, bumper 18, and combination wheel retainer 24 may be made of a material with elastomeric characteristics to provide a surface more conducive to gripping by a user as well as preventing damage due to impact from those components during use. FIG. 1*b* shows the resettable combination cable lock 10 with the shackle 63 installed instead of the cable 15. The shackle 63 is shown inserted into the access orifice 11.

When the combination wheels 12 are not aligned according to the proper combination, the slide 16 cannot be moved relative to the lock body housing 14 and the cable 15 is locked in position. When the combination wheels 12 are aligned according to the proper combination, the slide 16 is movable relative to the lock body housing 14 and can slide along the housing until the slide abuts the bumper 18. When the slide 16 is against the bumper 18, the cable 15 is movable relative to the lock body housing 14. When the slide is against the bumper 18 the combination wheel retainer 24 is also released so that it can be removed to allow the combination wheels 12 to be manipulated to reset the lock's combination.

Figure 2:
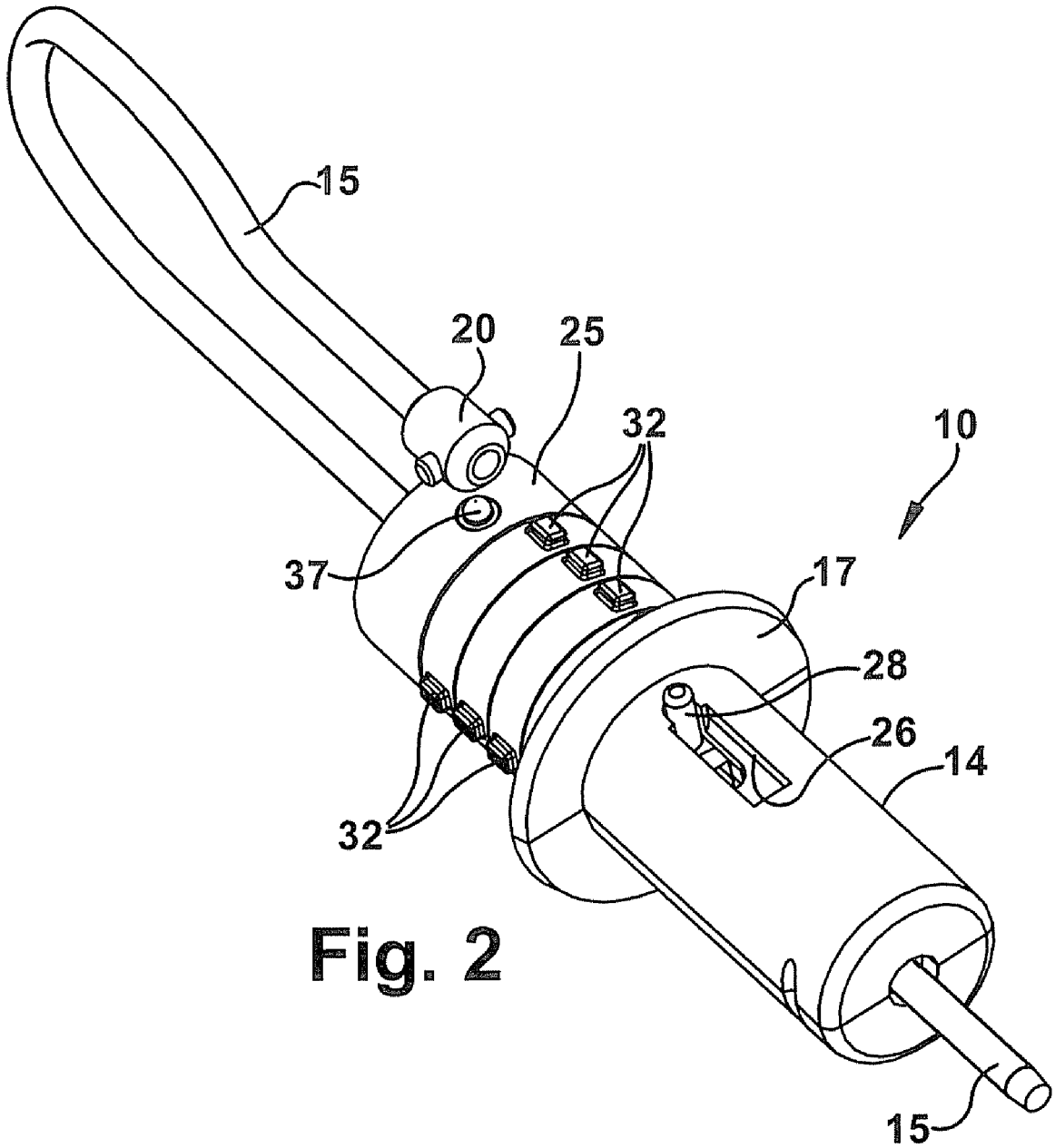
FIG. 2 is a perspective view of the resettable combination cable lock of FIG. 1 with outer components removed to reveal inner components.

FIG. 2 illustrates the resettable combination cable lock 10 with the combination wheel retainer, combination wheels, slide, and bumper removed. In this view the lock body housing 14 can be seen more completely. The lock body housing includes a slide pin guiding slot 26 through which a slide pin 28 is permitted to travel along a limited length of the housing. The slide pin 28 connects the slide 16 (FIG. 1) to a lock mechanism, such as a spool mechanism 52 (FIG. 4) that actuates locking members, such as locking jaws 44. The slide pin also connects the slide to a combination wheel retainer release feature, both of which will be described in more detail below. A set of locking wheels 32, each corresponding to a combination wheel, are retained on the housing by a locking wheel retainer 25. The locking wheel retainer 25 houses a locking pin 37 that connects the locking wheel retainer to the lock body housing 14.

Figure 3:
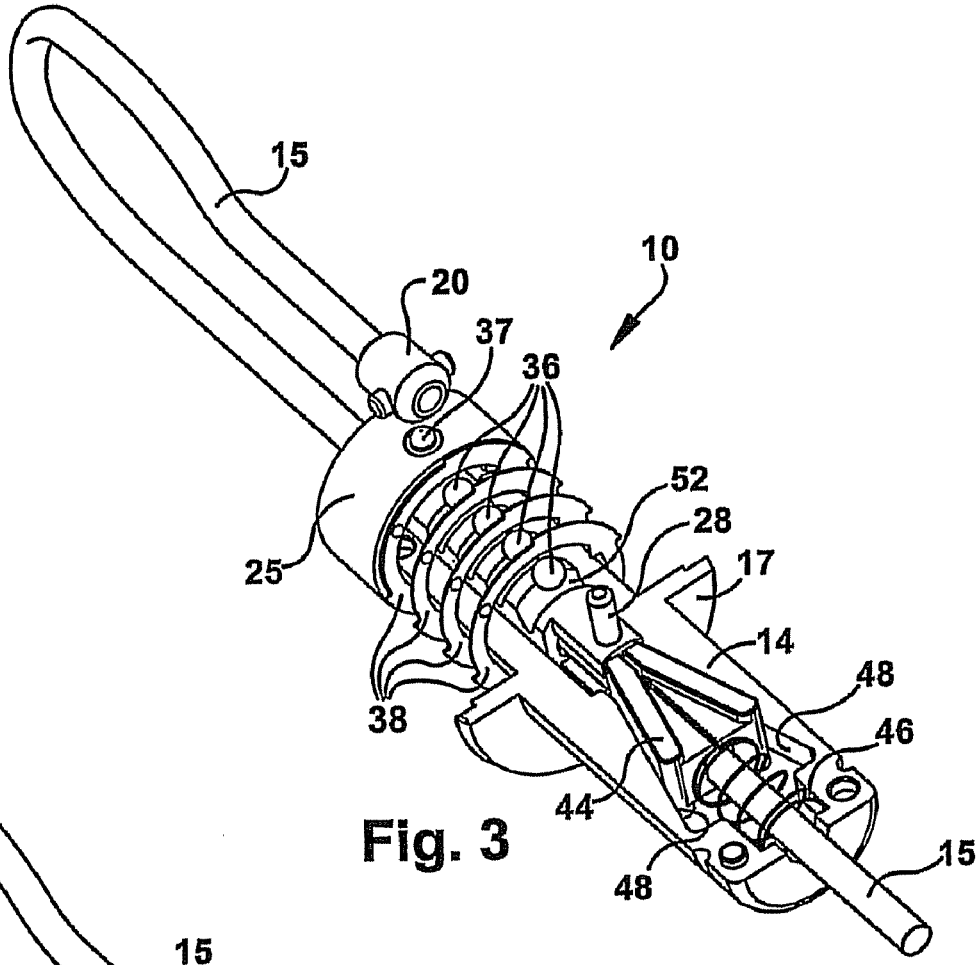
FIG. 3 is a partial cross section view of the resettable combination cable lock of FIG. 1.

FIG. 3 illustrates the resettable combination cable lock 10 with the lock body housing 14 in cross section and the locking wheels removed. A set of locking balls 36, each corresponding to a locking wheel, are retained in grooves in the spool 52. The number of locking wheels and locking balls can vary in the practice of the invention. A clutch spring 38 is installed between the locking wheels. The spool 52 is connected to the slide 16 (FIG. 1) with the slide pin 28, which allows the spool and slide to move as a single piece relative to the lock body housing 14.

The lock mechanism by which the cable 15 is retained in the lock body housing 14 is also shown in FIG. 3. The lock mechanism controls lock members to engage or release the cable. In an exemplary embodiment, the lock mechanism includes the spool 52 and the lock members are a pair of locking jaws 44 connected at one end of the spool. The jaws 44 may be constructed of zinc, or any other suitable material. Together, the locking jaws define an interior passageway through which the cable 15 passes. The locking jaws 44 are housed within a guide channel 48 that cam the jaws together when the slide 16 (FIG. 1) and spool 52 are moved away from the bumper and cam the jaws apart when the slide 16 and spool 52 are moved toward the bumper. The locking jaws 44 grip the cable to lock it in position when the jaws are in the closed position shown in FIG. 3. A compression coil spring 46 abuts an end of the locking jaws 44 to urge the locking jaws in a direction away from the bumper and tends to lock the cable in position. In this manner, the compression coil spring 46 prevents the cable 15 from being released without a user moving the slide 16 against the force of the compression coil spring 46.

Figure 4:
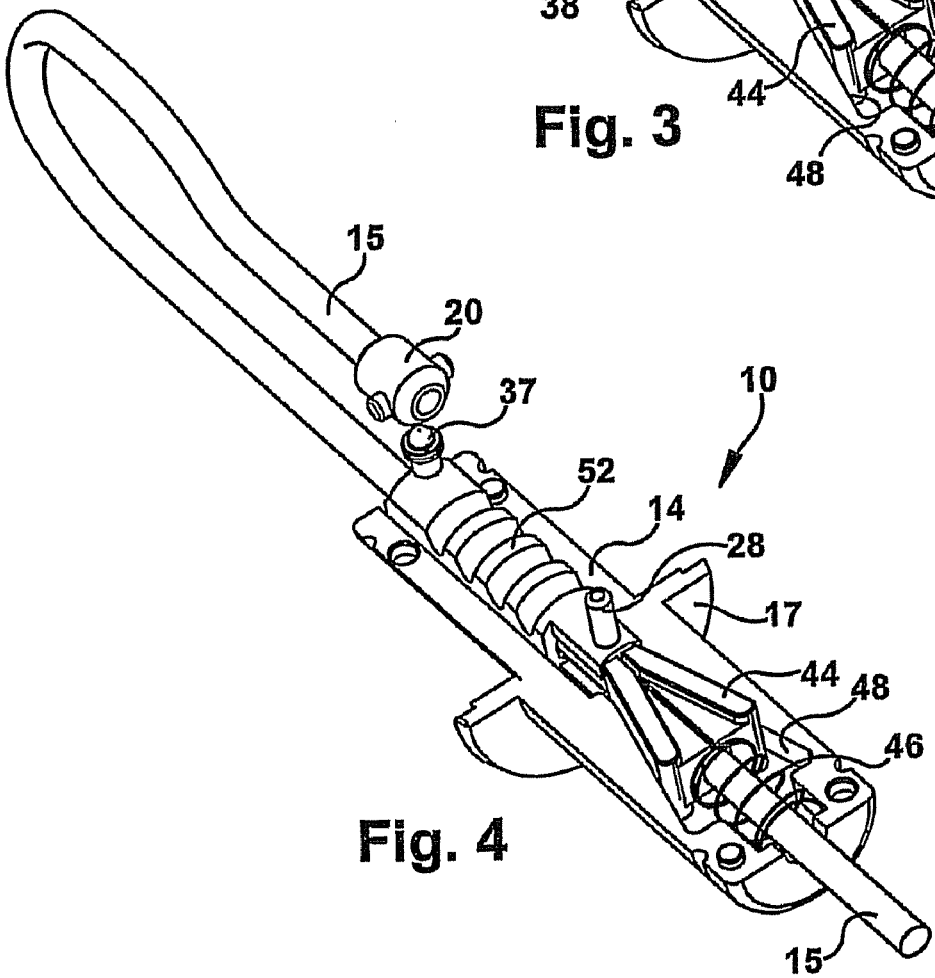
FIG. 4 is an additional partial cross section view of the resettable combination cable lock of FIG. 1.
Figure 5:
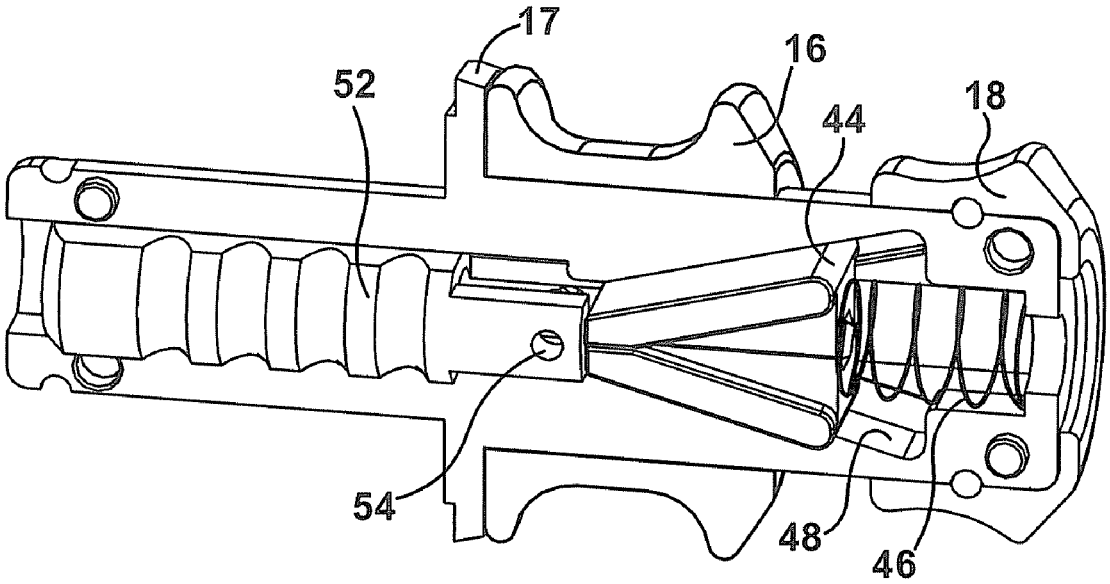
FIGS. 5-13 are partial cross section fragmentary views of the resettable combination cable lock of FIG. 1.

FIG. 4 shows the resettable combination cable lock 10 with the locking wheel retainer, clutch springs, and locking balls removed to provide a more complete view of the spool 52. The spool is moveably housed within the guide channel 48 in the lock body housing 14 and can travel between a clamping position shown in FIGS. 4 and 5 and a released position shown in FIG. 6. The spool has at one end the slide pin 28 that connects the spool to the slide 16 (FIG. 1). The locking pin 37 is supported from below by the other end of the spool when the spool is in the clamping position. As will be described in more detail with reference to FIGS. 11-13, when the spool slides towards the bumper, the locking pin 37 is released and retracts into the lock body housing 14 to allow the combination wheel retainer 24 to be removed from the lock body housing 14.

Figure 7:
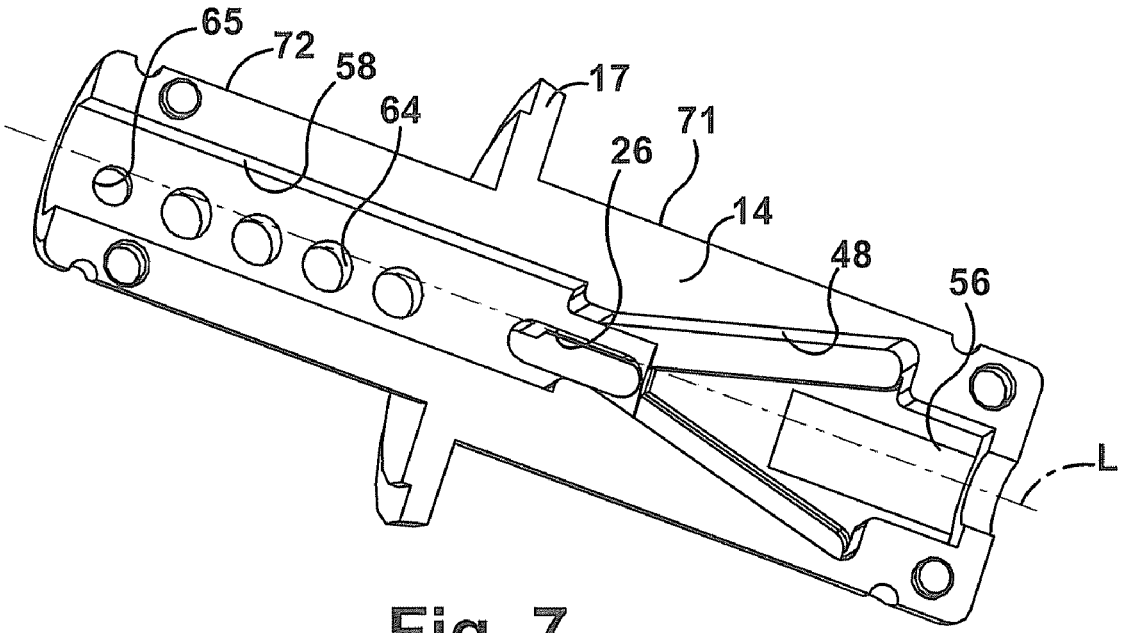

FIG. 7 is a cross section view of the lock body housing 14 which is generally cylindrical about a longitudinal axis L. The lock body housing has a first outer surface 71 that supports the slide and a second outer surface 72 that supports the locking wheels. The first and second outer surfaces are separated by a housing stop 17 that defines one end of travel for the slide. The lock body housing 14 includes the guide channel 48. The guide channel 48 includes a stepped, generally cylindrical bore 58 centered about the axis L that houses the spool 52 (FIG. 4). The lock body housing includes a locking ball hole 64 for each locking ball 36 (FIG. 3). The locking ball holes 64 are sized to allow passage of a locking ball. A counter bored locking pin hole 65 is present in the lock body housing 14 that allows passage of the locking pin 37 (FIG. 4). The slide pin guiding slot 26 provides clearance for the slide pin 28 (FIG. 4). Locking jaw guide channels 48 and a compression coil spring cavity 56 are also present within the generally cylindrical lock body housing 14.

Figure 6:
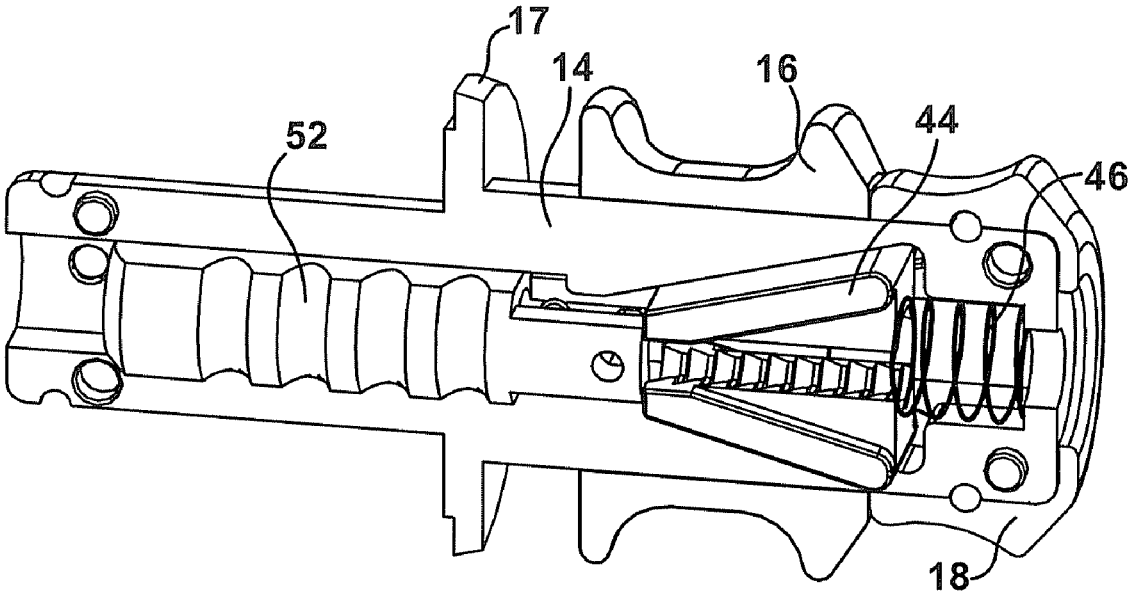
Figure 8:
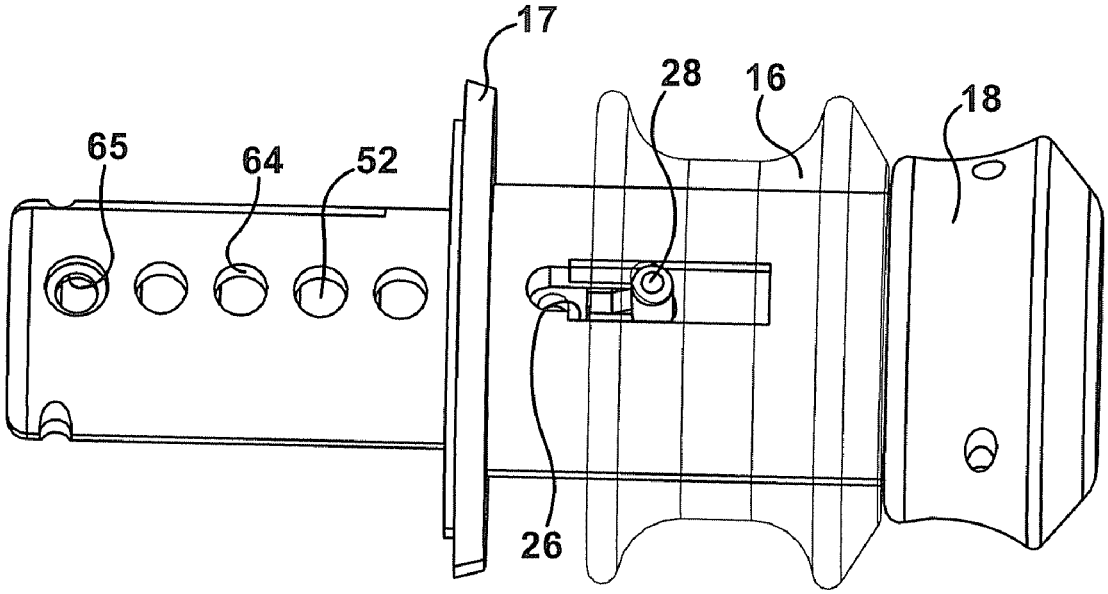

FIG. 8 is a side view of the lock body housing 14 that illustrates the interaction of the slide 16 (shown in phantom), the spool 52, and the bumper 18 with respect to the lock body housing. The spool 52 is contained within the lock body housing 14 and is connected to the slide 16 with the slide pin 28. To allow the spool 52 and slide 16 to move relative to the lock body housing 14, the lock body housing includes the slide pin guiding slot 26 through which the slide pin protrudes. The slide 16 is shown in the released position, in which the biasing force of the compression coil spring 46 has been overcome and the slide is resting against the bumper 18. As described above, when the slide and spool are in this position, the locking jaws are cammed apart by the guide channel 48 to release the cable as shown in FIG. 6. In FIG. 8, the counter bore feature of the locking pin hole 65 is illustrated. This feature facilitates the removal of the combination wheel retainer 24 as will be described in more detail below.

Figure 9:
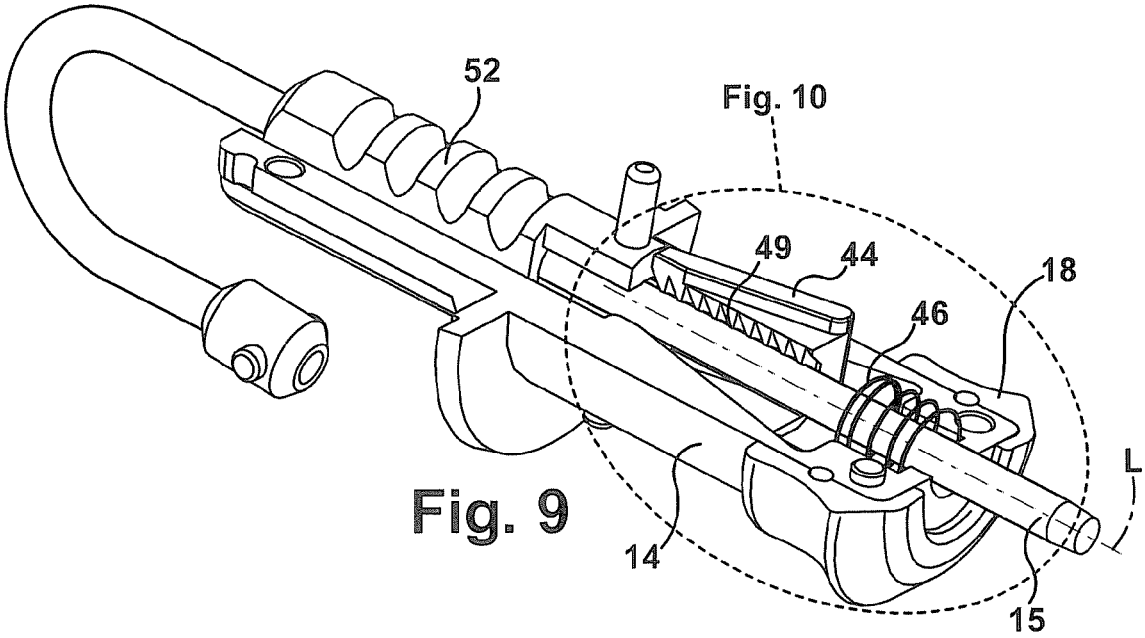
Figure 10:
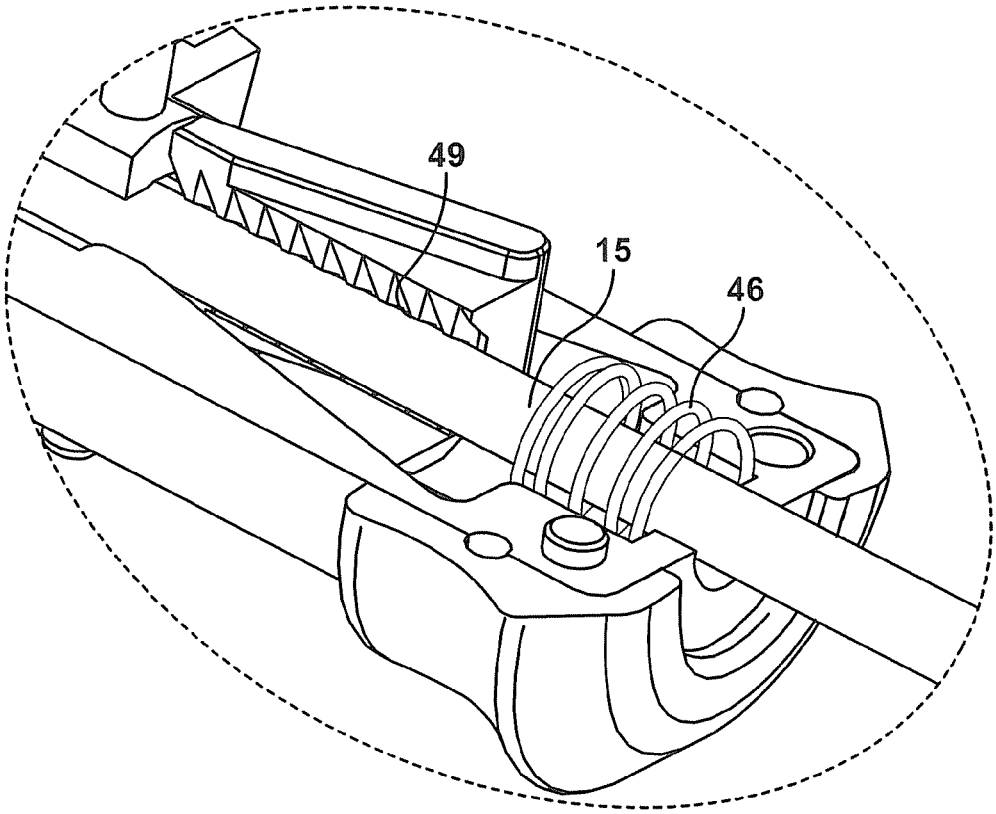

FIGS. 9 and 10 are cut away views in which portions of the lock body housing 14 and the spool 52 have been removed to better illustrate the interface between the locking jaws 44 and the cable 15. The locking jaws have serrations 49 that are angled to permit movement of the cable 15 in a direction toward the bumper 18 when the locking jaws are clamping the cable but resist movement of the cable in a direction toward the combination lock when the locking jaws are clamping the cable. In addition, the increased force to remove the cable increases the clamping forces of the jaws.

Figure 11:
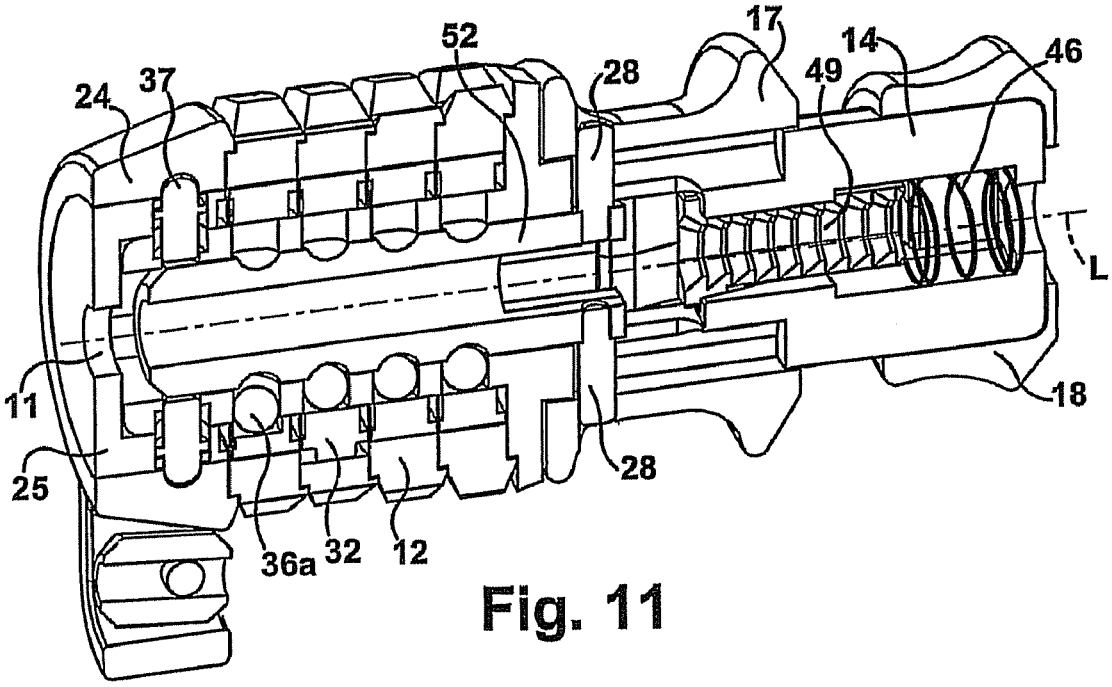
Figure 12:
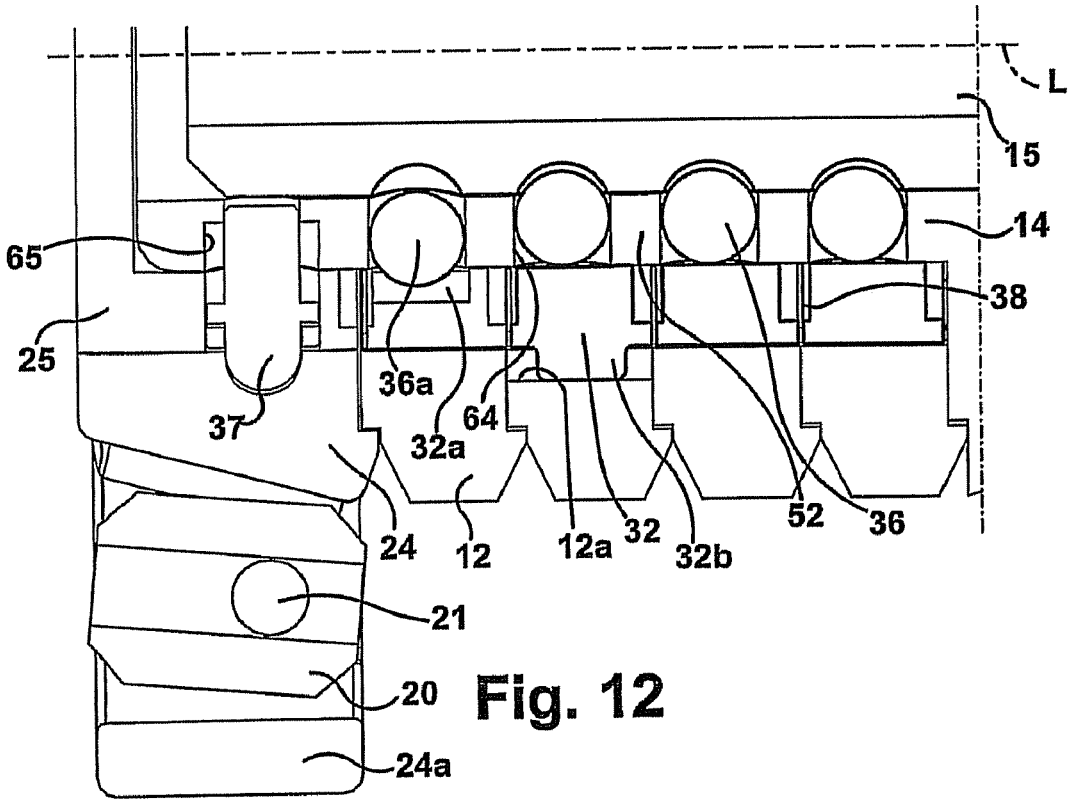
Figure 13:
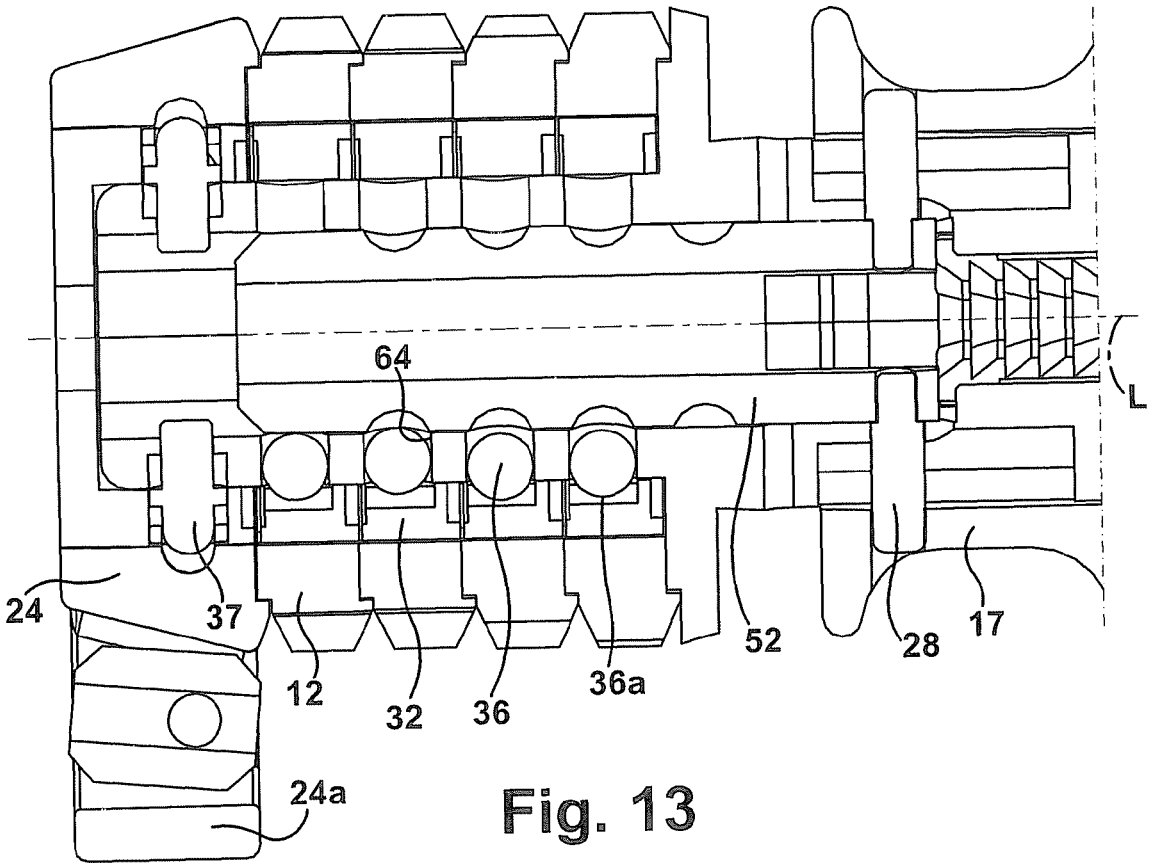

FIGS. 11-13 illustrate the combination lock portion of the resettable combination cable lock. In FIGS. 11 and 12, three of the four locking balls 36 are retained in engagement within grooves in the spool 52 by the locking wheels 32. The locking ball designated 36*a* is released from engagement with the spool 52 because its locking wheel 32 has been oriented so that a locking ball pocket 32*a* is aligned with the locking ball hole 64 in the lock body housing 14. This alignment provides a passage for the locking ball 36 to move out of engagement with the spool. When all of the locking wheels are oriented so that their locking ball pocket is aligned with the locking ball hole 64, as shown in FIG. 13, the spool is free to move within the lock body housing 14 and the slide 16 can be moved to release the cable 15. Each locking wheel 32 includes locking wheel tabs 32*b* (also shown in FIG. 2) that engage locking wheel pockets 12*a* in the combination wheels 12 to maintain alignment between the locking wheel and combination wheel.

When the spool 52 is in the clamping position shown in FIGS. 11 and 12, the locking pin 37 rests on the spool 52 and protrudes through a hole in the locking wheel retainer 25 and into a pocket in the combination wheel retainer 24. In this manner, the locking prevents removal of the combination wheel retainer 24 when the spool is in the locked position. As can be seen in FIG. 13, when the spool moves to the released position, the locking pin 37 drops out of engagement with the combination wheel retainer 24 and is retained in the counter bored portion of the locking pin hole 65 in the lock body housing 14. The combination wheel retainer 24 can now be removed and the combination wheels 12 re-aligned with respect to the locking wheels 32 to change the resettable combination cable lock's combination. When the spool returns to the locked position, the locking pin 37 moves back up to engage the combination wheel retainer if it is properly installed on the resettable combination cable lock 10.

FIG. 14 is a cross section view of the resettable combination cable lock with the shackle 63 installed. A long leg 63*a* is inserted into the lock body. Serrations 65 on the long leg 63*a* are engaged by the serrations 49 on the locking jaws to retain the shackle 63 in place. It is not necessary to modify the lock mechanism in any way when changing the type of securement member that is in use. In this manner, the shackle or the cable can be interchangeably used with the same lock body.

While various aspects of the invention are described and illustrated herein as embodied in combination in the exemplary embodiments, these various aspects may be realized in many alternative embodiments not shown, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, and so on may be described herein, such descriptions are not intended to be a complete or exhaustive list of available alternative embodiments, whether presently known or later developed. Those skilled in the art may readily adapt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however; such values and ranges are not to be construed in a limiting sense and are intended to be critical values or ranges only if so expressly stated.

I claim:

1. A lock comprising:

a lock body including a guide channel and an access orifice that provides access to the guide channel from outside the lock body;

an elongated securement member;

a locking mechanism disposed within the guide channel, the locking mechanism comprising a spool slideably disposed within the channel in the lock body and capable of being moved between a first position and a second position, an interior passageway passing longitudinally through an interior of the spool, and a pair of clamping jaws operatively connected to a first end portion of the spool, the pair of clamping jaws comprising an interior surface that defines a gripping surface that extends longitudinally about the interior passageway, the gripping surface being configured to closely surround and lockingly engage the securement member when the jaws are in a clamping position, and to allow movement of the securement member when the jaws are in a spread position; and a combination lock mechanically coupled to the locking mechanism, the combination lock operable to place the locking mechanism in a locked condition in which the clamping jaws secure the securement member in a fixed position and, upon entry of a proper combination, to place the locking mechanism in a released condition in which the clamping jaws are capable of releasing the securement member;

wherein the lock body channel comprises jaw guide surfaces that act upon the jaws to allow the jaws to move toward one another when the spool is placed in the first position and urge the jaws apart from one another when the spool is placed in the second position.

2. The lock of claim 1 wherein the securement member comprises a length of flexible cable.

3. The lock of claim 2 wherein the cable comprises a cable anchor configured to be retained in the lock body.

4. The lock of claim 1 wherein the securement member comprises a shackle having a first leg configured to be engaged by the clamping jaws and a second leg configured to be received in a retaining portion of the lock body.

5. The lock of claim 1 wherein the clamping jaws comprise one or more engagement features configured to engage corresponding securement member engagement features.

6. The lock of claim 5 wherein the clamping jaws engagement features and the securement member engagement features comprise serrations.

7. The lock of claim 1 wherein a length of the securement member that remains outside the access orifice is determined by a point along the securement member at which the locking mechanism engages the securement member.

8. The lock of claim 1 wherein the interior passageway is aligned longitudinally with the guide channel.

9. The lock of claim 1 wherein the spool comprises at least one groove disposed about its circumference and receiving a locking ball, and wherein the combination lock comprises at least one wheel disposed circumferentially about the spool, the wheel includes a pocket configured to allow disengagement of the locking ball from the groove when the wheel is rotated to an unlock position relative the spool.

10. The lock of claim 9 wherein the lock body comprises a combination lock retainer that is removable from the lock body when a proper combination is present on the combination lock and wherein the wheel can be repositioned relative the spool when the combination lock retainer is removed.

11. The lock of claim 1 wherein the lock body comprises a slide coupled to the spool that is configured to move the spool between the first and second position when a proper combination is present on the combination lock.

12. A method of securing and releasing a securement member within a lock body, the method comprising:

installing a first end of the securement member into an access orifice in the lock body and into a guide channel in the lock body;

passing the first end of the securement member through an interior passageway in a locking mechanism such that one or more locking members coupled to the locking mechanism engage the securement member to fix and maintain a position of the securement member within the lock body;

aligning one or more wheels of a combination lock to release the locking mechanism for sliding movement within the guide channel;

manually sliding a spool portion of the locking mechanism within the guide channel to a release position, to slidingly move the one or more locking members out of engagement with the securement member; and withdrawing the securement member from the access orifice in the lock body.

13. The method of claim 12 including the step of adjusting a length of the securement member outside of the access orifice by positioning the securement member within the interior passageway of the locking mechanism.

14. The method of claim 12 wherein the step of installing the first end of the securement member into the access orifice is performed by inserting one leg of a shackle into the access orifice.

15. The method of claim 12 wherein the step of installing the first end of the securement member into the access orifice is performed by inserting a flexible cable into the access orifice.

16. A lock system comprising:

a flexible cable comprising a cable anchor disposed at a distal end; and a lock comprising:

a lock body including a guide channel, an access orifice that provides access to the guide channel from outside the lock body, and a cable retaining ear configured to receive the cable anchor and constrain the cable anchor from movement in at least one longitudinal direction within the cable retaining ear;

a locking mechanism disposed within the guide channel, the locking mechanism comprising a slideable spool operatively connected to one or more locking members disposed about an interior passageway being configured to allow passage of an elongate cable through the passageway from the access orifice, the interior passageway being longitudinally aligned with the guide channel, the one or more locking members being configured to selectively engage the cable to maintain the cable in a fixed position relative to the lock body or release the cable such that the cable can be moved relative to the lock body; and a lock mechanically coupled to the locking mechanism, the lock operable to place the locking mechanism in a locked condition in which the one or more locking members secure the cable in a fixed position and, upon unlocking, to place the locking mechanism in a released condition in which the spool is manually slideable to move the one or more locking members to release the cable.

17. The lock system of claim 16 further comprising a shackle interchangeable with the flexible cable and having a first leg configured to be engaged by the one or more locking members and a second leg configured to be installed within the cable retaining ear.

* * * * *